United States Patent [19]

Royce

[11] Patent Number: 4,936,538

[45] Date of Patent: Jun. 26, 1990

[54] TREE STAND

[76] Inventor: Mark B. Royce, 1009 Lucas St., Georgetown, S.C. 29440

[21] Appl. No.: 252,389

[22] Filed: Oct. 3, 1988

[51] Int. Cl.[5] ..... F16M 13/00

[52] U.S. Cl. ..... 248/524; 47/40.5

[58] Field of Search ..... 248/519, 523, 524, 346; 47/40.5

[56] References Cited

U.S. PATENT DOCUMENTS

| | | | |
|---|---|---|---|
| 909,634 | 1/1909 | Mitchell | 248/523 |
| 1,401,259 | 12/1921 | Ihrig | 248/524 |
| 1,496,272 | 6/1924 | Jutz, Sr. | 248/524 |
| 1,607,358 | 11/1926 | Morgan | 248/523 |
| 2,029,281 | 1/1936 | McCann | 248/524 X |
| 2,502,040 | 3/1950 | Franklin | 248/524 X |
| 2,639,877 | 5/1953 | Fox | 248/523 X |
| 2,754,075 | 7/1956 | Nelson | 248/523 |
| 3,002,721 | 10/1961 | Perkins | 248/524 X |
| 4,310,989 | 1/1982 | Shannon, Jr. | 248/523 X |
| 4,326,703 | 4/1982 | Marley | 248/523 X |

FOREIGN PATENT DOCUMENTS

| | | | |
|---|---|---|---|
| 283903 | 4/1915 | Fed. Rep. of Germany | 248/523 |
| 517609 | 1/1931 | Fed. Rep. of Germany | 248/524 |
| 450093 | 3/1913 | France | 248/523 |

*Primary Examiner*—David L. Talbott

*Attorney, Agent, or Firm*—Frank P. Presta

[57] ABSTRACT

A stand for a cut tree or the like, comprising a frame and two pairs of support arms movably mounted on the frame in vertically spaced relation. The support arms of one pair extend generally laterally in a direction that is substantially perpendicular to the lateral direction in which the support arms of the other pair extend. The support arms of each pair have generally V-shaped recessed portions adapted to engage a tree trunk placed in the stand between the support arms of each pair. Suitable locking devices are provided to releasably secure each pair of support arms in desired laterally spaced positions so that the recessed portions thereof can engage and support tree trunks of different sizes and shapes.

6 Claims, 2 Drawing Sheets

Fig. 1
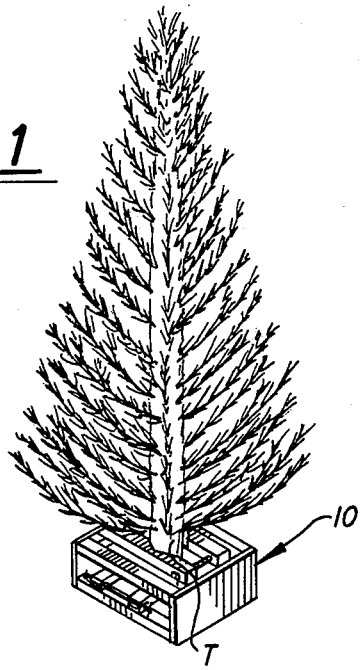
Fig. 4
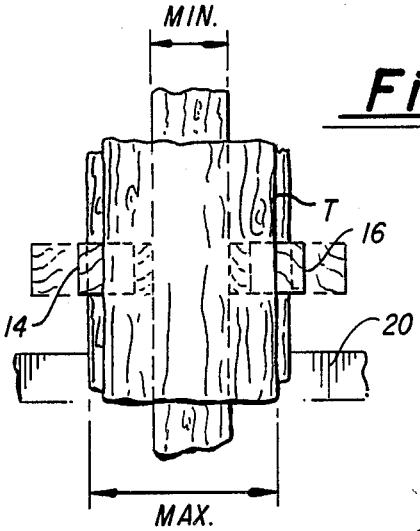
Fig. 2
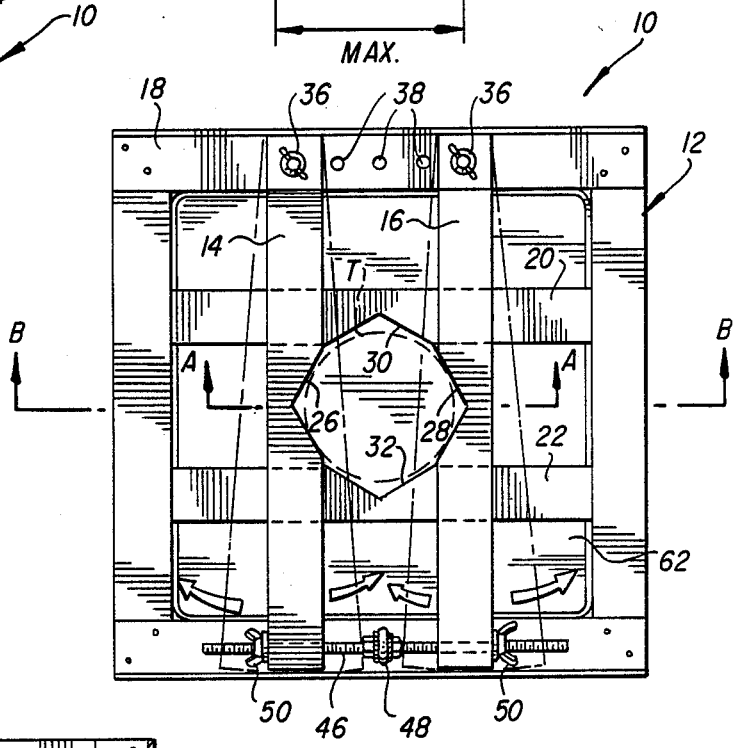
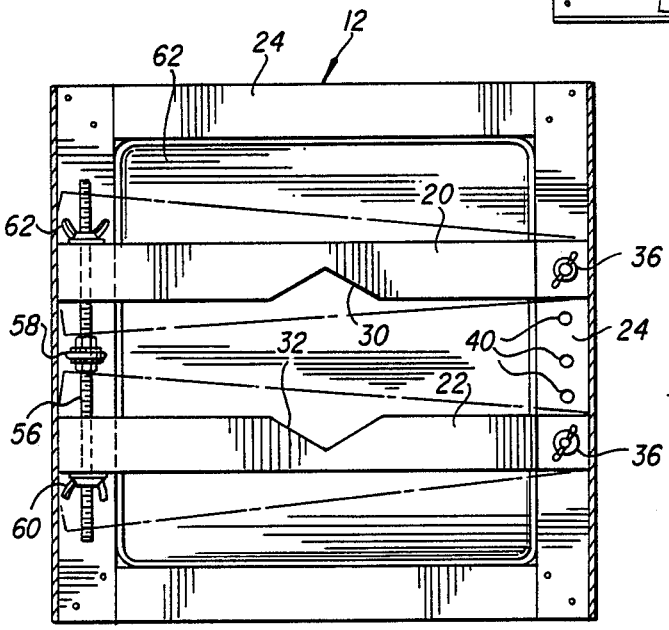
Fig. 3

TREE STAND

BACKGROUND OF THE INVENTION

The present invention relates to a tree stand and, more particularly, to a stand for a cut tree or the like which can support in a stable manner trees of various sizes and shapes.

Up to the present time, many different types of stands have been used to support cut trees such as Christmas trees. Although these stands have generally served their intended purpose, they have been subject to one or more of the disadvantages. Many Christmas tree stands are structured with a base that has a round receptacle into which a tree trunk is placed. They also contain a vertical spike at the center inside the receptacle upon which the tree is driven in order to assist in the prevention of leaning or toppling. This feature additionally requires lateral screws which are manually turned and screwed into the tree trunk for more support. Such stands must be manipulated with considerable care since the assembler cannot see into the receptacle to ascertain if the lateral screws are in the proper place, and if the vertical spike is in the center and straight. If not done correctly, the assembly process must be repeated until it is satisfactorily completed. In order to perform the above, it is necessary for the assembler to bend or lie down and often requires two people—one to hold the tree straight while the other makes the necessary adjustments at the bottom of the tree.

Accordingly, a need has arisen for a tree stand that is simple in construction, easy to use and can support cut trees of different sizes and shapes in a stable manner. The tree stand of the present invention fills this need, is not subject to any of the above-listed disadvantages, and possesses many advantages not found in previously used tree stands.

It is an object of this invention that the above may easily be accomplished and improved on in a completely different manner with a new and uniquely designed device that a single individual may easily handle, without bending or lying down, and which will insure accuracy and safety from leaning or toppling.

SUMMARY OF THE INVENTION

The tree stand of the present invention generally comprises a frame and two pairs of support arms movably mounted on the frame in vertically spaced relation. The support arms of one pair extend generally laterally in a direction that is substantially perpendicular to the lateral direction in which the support arms of the other pair extend. The support arms of each pair are provided with inwardly facing, generally V-shaped recessed portions adapted to engage a tree trunk placed in the stand between the support arms of each pair. The recessed portions of the support arms define generally vertically aligned openings that are adjustable in size to receive the tree trunk therethrough. Suitable locking devices are provided to releasably secure each pair of support arms in desired laterally spaced positions so that they can engage and support tree trunks of different sizes and shapes.

BRIEF DESCRIPTION OF THE DRAWINGS

FIG. 1 is a perspective view of the tree stand of the present invention with the trunk of a cut tree supported therein;

FIG. 2 is a top plan view of the tree stand of the present invention;

FIG. 3 is a plan view of the tree stand shown in FIG. 2 with the upper portion thereof removed;

FIG. 4 is a sectional view taken substantially along line A—A in FIG. 2, showing a range of tree trunk sizes that can be supported by the tree stand;

DESCRIPTION OF THE PREFERRED EMBODIMENTS

Figure 6:
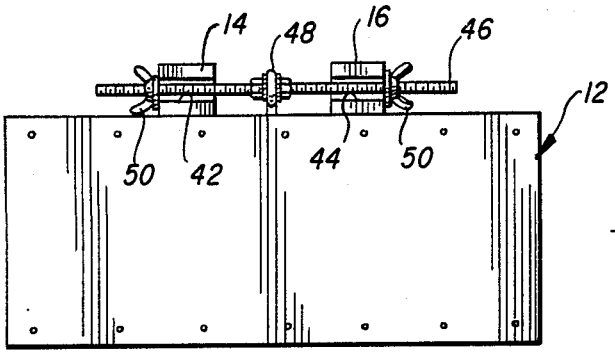
FIG. 6 is an elevational view of one side of the tree stand.
Figure 7:
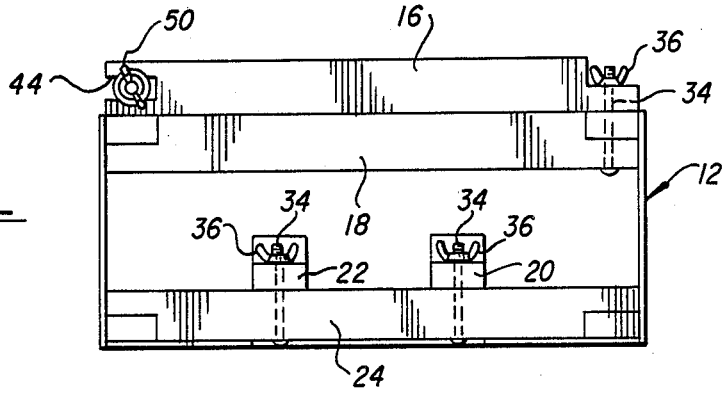
FIG. 7 is an elevational view of another side of the tree stand.

The tree stand 10 of the present invention generally comprises a frame 12 of any desired shape, construction and materials, a first pair of support arms 14, 16 movably mounted on an upper portion 18 of the frame 12, and a second pair of support arms 20, 22 movably mounted on a lower portion 24 of the frame. Preferably, the frame 12 is of generally square configuration and is formed of a suitable wood or plastic material.

Figure 5:
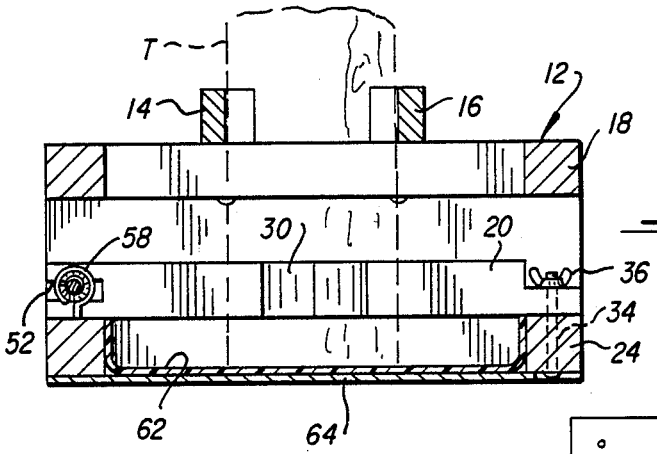
FIG. 5 is a sectional view taken substantially along line B—B in FIG. 2.
Figure 8:
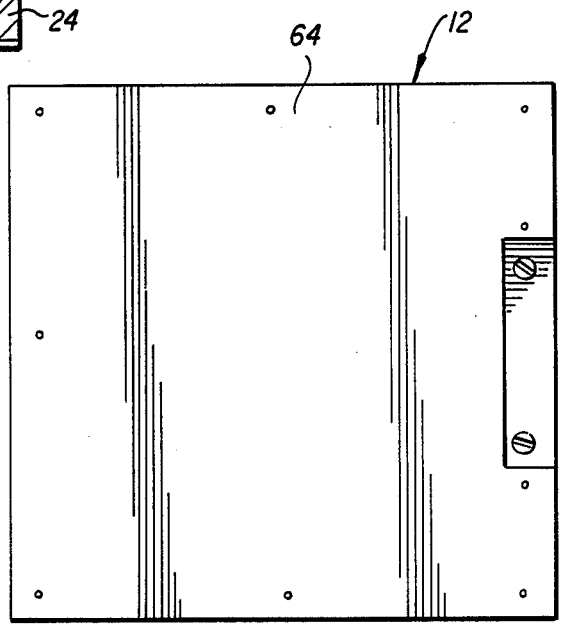
FIG. 8 is a bottom plan view of the tree stand.

As shown in FIGS. 2 and 3, the support arms 14, 16 and 20, 22 of each pair extend in generally parallel relation to each other and are preferably pivotally connected at one end to the adjacent upper and lower frame portions 18 and 24, respectively, so that the spacing between the support arms of each pair can be varied. The support arms 14, 16 of the first pair extend generally laterally in a direction that is substantially perpendicular to the direction in which the support arms 20, 22 of the second pair laterally extend. The support arms 14, 16 of the first pair are provided with inwardly facing, generally V-shaped recessed portions 26, 28 in the middle areas thereof which are positioned to engage adjacent portions of a tree trunk T inserted in the stand, as shown in FIGS. 1, 2 and 4. Similarly, as additionally shown in FIG. 3, the support arms 20, 22 of the second pair are provided with inwardly facing, generally V-shaped recessed portions 30, 32 in the middle areas thereof which are positioned to engage adjacent portions of a tree trunk T inserted in the stand. As illustrated in FIGS. 2 and 5, the tree trunk openings defined by the upper recessed portions 26, 28 and the lower recessed portions 30, 32 are generally vertically aligned in the center area of the stand 10.

The one end of each of the support arms 14, 16 and 20, 22 may be pivotally connected to the upper and lower frame portions 18, 24 in any suitable manner. As an illustrative example, threaded bolts 34 extending through aligned bores in the support arms and adjacent frame portions may be utilized, and wing nuts 36 may be used to retain the one end of each support arm on the adjacent frame portion, as shown in FIGS. 2, 3, 5 and 7. The spacing of the pivoted ends of the support arms 14, 16 and 20, 22 can be varied by providing additional bores 38 and 40 in the frame portions 18 and 24, respectively (see FIGS. 2 and 3).

As a illustrative example, the use of the center bore 38 or 40 in conjunction with one of the end bores will allow the arms 14, 16 or 20, 22 to be offset to the left or right for the purpose of compensating for a crooked tree trunk and positioning the top of the tree in a vertical position.

The other end of each support arm 14, 16 is provided with a slot 42, 44 through which an elongated rod 46 extends. The rod 46 is mounted on the frame portion 18 in any suitable manner, such as by an eyelet member 48, and preferably is threaded so as to receive wing nuts 50 or the like on the end portions thereof which can be rotated on the rod 46 to move the other ends of the support arms 14, 16 to desired positions to control the spacing between them and the size of the opening defined by the recessed portions 26, 28.

Similarly, the other end of each support arm 20, 22 is provided with a slot 52, 54 through which an elongated rod 56 extends. The rod 56 is mounted on the frame portion 24 in any suitable manner, such as by an eyelet member 58, and preferably is threaded so as to receive wing nuts 60 or the like on the end portions thereof which can be rotated on the rod 56 to move the other ends of the support arms 20, 22 to desired positions to control the spacing therebetween and the size of the opening defined by the recessed portions 30, 32.

As shown in FIGS. 2, 3 and 5, the lower frame portion 24 defines a recess in which a tray 62 is removably mounted for holding water or other liquids to feed a tree trunk positioned within the stand 10. The tray 62 rests on a bottom panel 64 secured to the frame 12.

In operation, when it is desired to support a tree or the like in the stand 10, the support arms 14, 16 and 20, 22 of each pair are spread apart a sufficient distance so that the trunk T can be inserted through the openings defined by the recessed portions 26, 28 and 30, 32, respectively, into engagement with the tray 62 supported on the bottom panel 64. By loosening the wing nuts 50 and 60 on the threaded rods 46 and 56, the support arms 14, 16 and 20, 22 can be pivoted outwardly a sufficient distance to accommodate the tree trunk through the recessed portions thereof.

Once the trunk is in place in the stand, the wing nuts 50 and 60 are tightened to press the recessed portions 26, 28 and 30, 32 of the support arms 14, 16 and 20, 22 into tight engagement with the adjacent portions of the tree trunk. Accordingly, the tree is supported at two different elevations in the stand 10 in a very stable manner. The pivotal movement of the support arms and the recessed portions thereof provide for the tight gripping of a tree trunk at different elevations even if the trunk is of uneven shape or cross section.

The support arms 14, 16 and 20, 22 may be set ahead of time by estimating the diameter of the tree trunk. The support arms may be set quickly and accurately to a precise setting. By placing the tree in a horizontal position and raised off the ground with an object under it, the assembler in a waist high position may insert the tree trunk into the stand. He may now take his hands off the stand and turn the two wing nuts 50, 60 simultaneously so that the support arms will uniformly move toward the center of the structure. When contact with the tree is made, the V-shaped recessed portions in the support arms will encompass the tree and hold it into a tight and secure position.

Finally, as an illustrative example, the V-shaped recessed portions in the support arms may be $3'' \times 1\frac{1}{2}'' \times \frac{3}{4}''$. These measurements total $4\frac{1}{2}$ square inches each—hence there is a total of 18 square inches that is available to encompass and hold the tree straight and secure it without the use of tools, spikes or screws. The support arms may be formed of wood, plastic or any other suitable material.

What is claimed is:

1. A stand for a cut tree or the like, comprising:

frame means;

a first pair of generally laterally extending support arms pivotally mounted at one end on said frame means so that said first support arms are movable toward and away from each other;

a second pair of generally laterally extending support arms pivotally mounted at one end on said frame means so that said second support arms are movable toward and away from each other, said second pair of support arms being vertically spaced from said first pair of support arms and extending in a direction that is substantially perpendicular to the direction in which said first pair extends;

each of said first and second support arms having a recessed portion positioned in the center area of said stand, said recessed portions defining vertically spaced openings for the insertion of a tree trunk or the like therein and being adapted to engage adjacent portions of a trunk positioned therebetween;

means for releasably urging said recessed portions into engagement with the trunk at different elevations thereof to support and retain the tree in the stand; said urging means being constructed to engage each of said support arms at the other end thereof opposite to said one end; and means for adjusting the pivotal mounting of the one ends of said support arms on said frame means, said adjusting means comprising openings in said frame means and in said support arms, and means extending through some of said openings for removably and pivotally mounting the one ends of said support arms on said frame means, said openings being positioned such that said support arms can be offset laterally to compensate for a crooked tree trunk and position the top of the tree in a vertical position.

2. The stand of claim 1 wherein a first rod is mounted on said frame means near the other end of each of said first support arms, a second rod is mounted on said frame means near the other end of each of said second support arms, and said urging means comprises nut means movably mounted on said first and second rods and being engageable with said other ends of said support arms.

3. The stand of claim 2 wherein said other ends of said first and second support arms have slots therein through which said first and second rods extend, respectively.

4. The stand of claim 1 wherein a tray is movably mounted on the bottom portion of said frame means for holding a liquid for feeding the tree trunk inserted therein.

5. The stand of claim 1 wherein said recessed portions are generally V-shaped.

6. The stand of claim 1 wherein said mounting means comprises bolts extending through some of said openings, and nuts movably mounted on said bolts.

* * * * *